US011302249B2

(12) United States Patent
Takasugi

(10) Patent No.: US 11,302,249 B2
(45) Date of Patent: Apr. 12, 2022

(54) DISPLAY CONTROL DEVICE AND METHOD OF CONTROLLING DISPLAY DEVICE

(71) Applicant: LG Display Co., Ltd., Seoul (KR)

(72) Inventor: Shinji Takasugi, Tokyo (JP)

(73) Assignee: LG Display Co., Ltd., Seoul (KR)

( * ) Notice: Subject to any disclaimer, the term of this patent is extended or adjusted under 35 U.S.C. 154(b) by 23 days.

(21) Appl. No.: 16/911,236

(22) Filed: Jun. 24, 2020

(65) Prior Publication Data

US 2020/0410930 A1 Dec. 31, 2020

(30) Foreign Application Priority Data

Jun. 27, 2019 (JP) ..... JP2019-119646

(51) Int. Cl.
*G09G 3/3225* (2016.01)

(52) U.S. Cl.
CPC ... *G09G 3/3225* (2013.01); *G09G 2340/0464* (2013.01)

(58) Field of Classification Search
None
See application file for complete search history.

(56) References Cited

U.S. PATENT DOCUMENTS

2017/0221455 A1* 8/2017 Lee ..... G09G 3/3233

FOREIGN PATENT DOCUMENTS

| | | | |
|---|---|---|---|
| JP | H10161580 | A | 6/1998 |
| JP | 2005257725 | A | 9/2005 |
| JP | 2008281611 | A | 11/2008 |
| JP | 2009-282151 | A | 12/2009 |
| JP | 2013044913 | A | 3/2013 |

* cited by examiner

*Primary Examiner* — Kent W Chang
*Assistant Examiner* — Benjamin Morales
(74) *Attorney, Agent, or Firm* — Seed IP Law Group LLP

(57) ABSTRACT

A display control device includes: a display processing part displaying an image in a display unit; and a movement processing part changing a display position of the image according to a display time of the image within a movement range having a reference display position of the image in the display unit as a center, wherein the movement processing part changes the display position within the movement range such that an accumulated display time of the image is reduced from the center to a periphery of the movement range.

13 Claims, 16 Drawing Sheets

DISPLAY CONTROL DEVICE AND METHOD OF CONTROLLING DISPLAY DEVICE

CROSS REFERENCE TO RELATED APPLICATIONS

The present application claims the priority benefit of Japanese Patent Application No. 2019-119646 filed in the Japan Patent Office on Jun. 27, 2019, which is hereby incorporated by reference in its entirety for all purposes as if fully set forth herein.

BACKGROUND

Technical Field

The present disclosure relates to a display control device and a method of controlling a display device.

Description of the Related Art

In a display device such as an organic light emitting diode (OLED) display device, a plasma display panel (PDP) device, a cathode ray tube (CRT) display, a liquid crystal display (LCD) device, etc., there exists a phenomenon, which is referred to as a 'burn-in,' that a function displaying an image is deteriorated when an equal image is displayed for a long time period. As a technology preventing the burn-in, a technology where a display position of an image in a display unit is changed as a time elapses. See patent documents 1 to 4.

In the patent document 1 (Japanese Patent Publication No. H10-161580), a position of an image is changed between a center position and a periphery position as a predetermined time elapses. In the patent document 2 (Japanese Patent Publication No. 2005-257725), a display position of an image is changed by one pixel along a diagonal direction with a predetermined period. In the patent document 3 (Japanese Patent Publication No. 2008-281611), a display position of an image is changed based on a plurality of moving trace modes where moving traces are different from each other. In the patent document 4 (Japanese Patent Publication No. 2013-044913), a display position of an on screen display (OSD) image is changed by one pixel based on a specific trace as a predetermined time elapses.

The technology of the patent documents 1 to 4 has an effect to an image having a size where display position overlap each other when the display position is changed in a long term. However, in an image such as a star sky, a bright light of a night view, etc., where some pixels such as one pixel or several pixels locally have a relatively high luminance, it is difficult that a stress applied to the pixel is favorably dispersed due to the technology of the patent documents 1 to 4. As a result, when the technology of the patent documents 1 to 4 is applied to an image where some pixels locally have a relatively high luminance, a stress amount applied to the pixel has a boundary portion and deterioration of the pixel is easily recognized by a user.

BRIEF SUMMARY

Accordingly, the present disclosure is directed to a display control device and a method of controlling a display device that substantially obviates one or more of the problems due to limitations and disadvantages of the related art.

An object of the present disclosure is to provide a display control device and a method of controlling a display device where a stress applied to a pixel is favorably dispersed even in an image where some pixels locally have a relatively high luminance.

Additional features and advantages of the disclosure will be set forth in the description which follows, and in part will be apparent from the description, or may be learned by practice of the disclosure. These and other advantages of the disclosure will be realized and attained by the structure particularly pointed out in the written description and claims hereof as well as the appended drawings.

To achieve these and other advantages and in accordance with the purpose of the present disclosure, as embodied and broadly described herein, a display control device includes: a display processing part displaying an image in a display unit; and a movement processing part changing a display position of the image according to a display time of the image within a movement range having a reference display position of the image in the display unit as a center, wherein the movement processing part changes the display position within the movement range such that an accumulated display time of the image is reduced from the center to a periphery of the movement range.

In another aspect, a display device includes: a display control device comprising: a display processing part displaying an image in a display unit; and a movement processing part changing a display position of the image according to a display time of the image within a movement range having a reference display position of the image in the display unit as a center, wherein the movement processing part changes the display position within the movement range such that an accumulated display time of the image is reduced from the center to a periphery of the movement range; and the display unit.

In another aspect, a method of controlling a display device includes: displaying an image in a display part; and changing a display position of the image according to a display time of the image within a movement range having a reference display position of the image in the display unit as a center, wherein changing the display position is performed such that an accumulated display time of the image is reduced from the center to a periphery of the movement range.

It is to be understood that both the foregoing general description and the following detailed description are provided as an example and are intended to provide further explanation of the disclosure as claimed. Other technical benefits would be readily apparent to a person skilled in the art beyond those mentioned herein.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 2 is a view showing a pixel deterioration due to a burn-in;

DETAILED DESCRIPTION

Figure 1A:
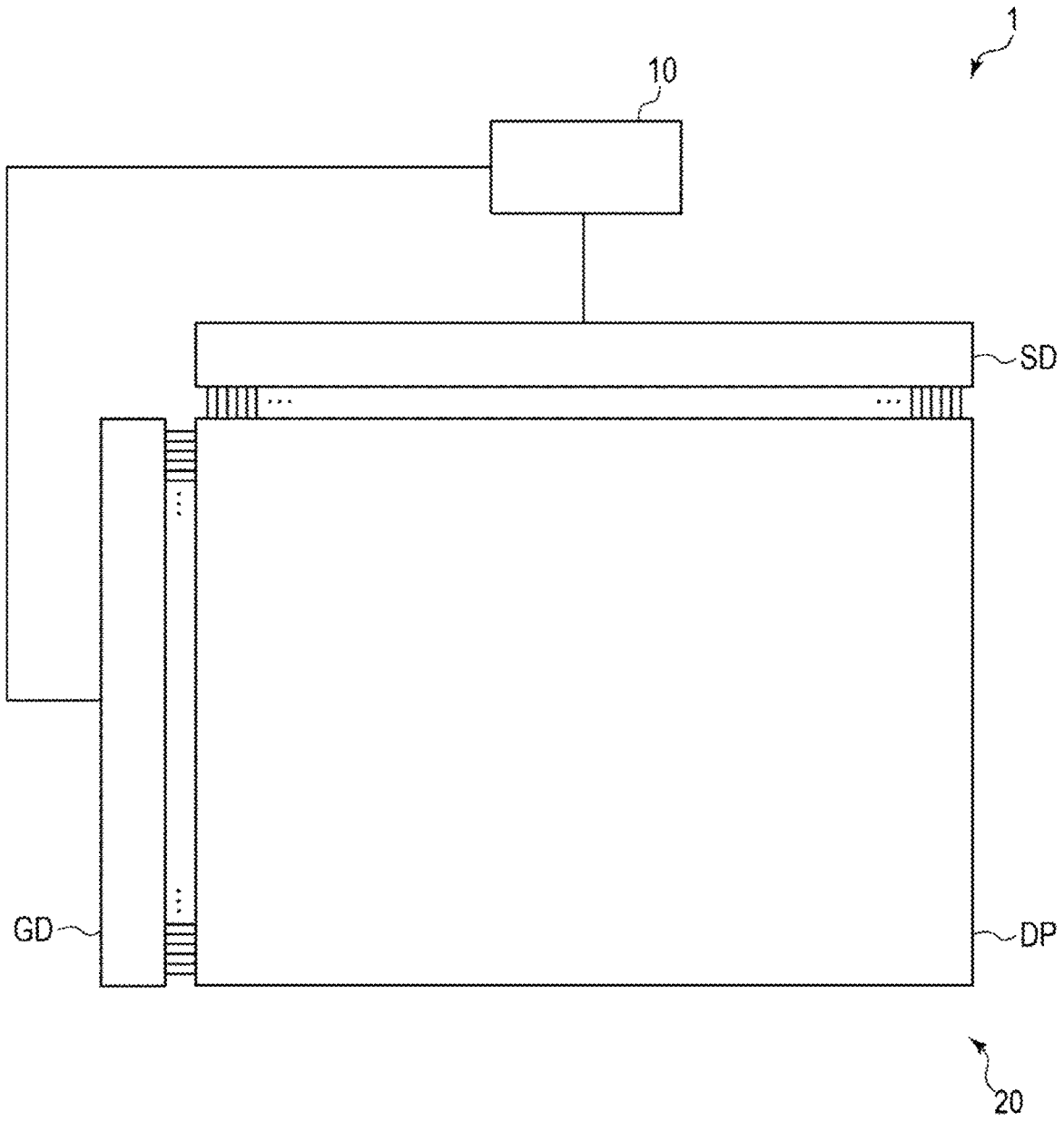
FIG. 1A is a view showing a display device including a display control device according to a first embodiment of the present disclosure.

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure.

Reference will now be made in detail to the present disclosure, examples of which are illustrated in the accompanying drawings.

Figure 1B:
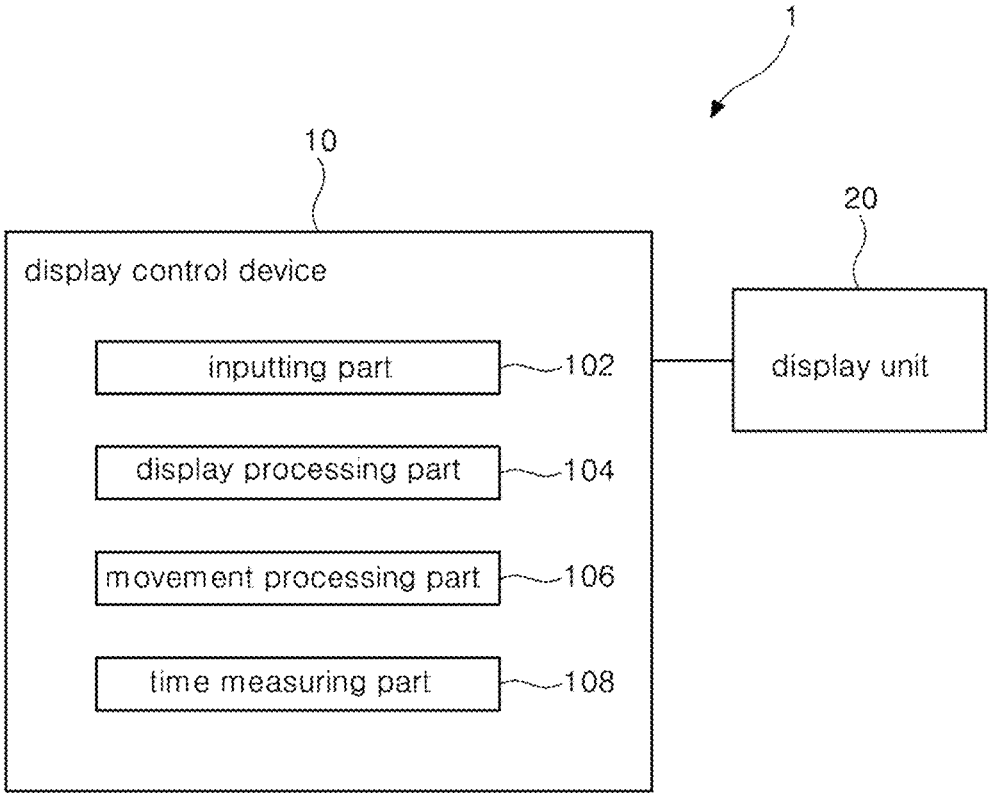
FIG. 1B is a block diagram showing a display device including a display control device according to a first embodiment of the present disclosure.

FIG. 1A is a view showing a display device including a display control device according to a first embodiment of the present disclosure, and FIG. 1B is a block diagram showing a display device including a display control device according to a first embodiment of the present disclosure.

In FIG. 1A, a display device 1 according to a first embodiment of the present disclosure includes a display control device 10 and a display unit 20. In the display device 1, the display unit 20 displays an image corresponding to an image signal according to a control of the display control device 10. The display device 1 receives the image signal from an external system. In another embodiment, the display device 1 may include a display unit displaying an image using an image signal generated from an internal system. For example, the display device 1 may be used as an image output device of a computer, a television, an electric scoreboard, an electric sign terminal, a kiosk terminal, a smart phone, a tablet terminal, a portable phone, a digital still camera, a digital video camera, a game console, etc. In addition, other suitable devices capable of incorporating a display may be utilized and a person skilled in the art would readily appreciate other devices may be used beyond those mentioned herein.

The display unit 20 includes a display panel DP, a gate driver GD and a source driver SD. The display panel DP includes a plurality of pixels disposed in a matrix.

The display control device 10 is communicatively connected to the gate driver GD and the source driver SD. For example, the display control device 10 may be formed as an integrated circuit (IC) including a display controller, a timing controller, a memory, etc. The display control device 10 controls an operation timing of the gate driver GD and the source driver SD based on timing signals (e.g., a vertical synchronization signal, a horizontal synchronization signal, a data enable signal, etc.) inputted from an external system. In addition, the display control device 10 generates a data representing a luminance of each sub-pixel of the display panel DP based on an input signal inputted from the external system and outputs the data to the source driver SD.

The source driver SD supplies a voltage for driving the plurality of pixels in the display panel DP through a plurality of data lines according to a control of the display control device 10. The gate driver GD supplies a scan signal to the plurality of pixels in the display panel DP through a plurality of gate lines according to a control of the display control device 10. The display control device 10 controls an operation of the whole display device 1.

In FIG. 1B, the display control device 10 according to a first embodiment of the present disclosure includes an inputting circuit 102, a display processing circuit 104, a movement processing circuit 106 and a time measuring circuit 108. In one or more embodiments, the inputting circuit 102 (which may be referred to herein as a inputting part 102), the display processing circuitry 104 (which may also be referred to herein as a display processing part 104), the movement processing circuit 106 (which may be referred to herein as a movement processing part 106), and the time measuring circuit 108 (which may be referred to herein as a time measuring part 108) may include any electrical circuitry, features, components, an assembly of electronic components or the like configured to perform the various operations and features of the inputting circuit 102, the display processing circuit 104, the movement processing circuitry 106, and the time measuring circuitry 108 as described herein. In some embodiments, the inputting part 102, the display processing part 104, the movement processing part 106, the time measuring part 108 may be included in or otherwise implemented by processing circuitry such as a microprocessor, microcontroller, integrated circuit, chip, microchip or the like.

The inputting part 102 includes an interface where an image signal corresponding to an image displayed by the display unit 20. The inputting part 102 performs a processing such as a conversion of the image signal as necessary.

The display processing part 104 receives the image signal supplied from the inputting part 102. The display processing part 104 controls the display unit 20 and displays the image in the display unit 20 according to the image signal. The display processing part 104 displays the image in the display unit 20 by controlling turning on and off the plurality of pixels of the display unit 20.

The movement processing part 106 performs an orbit processing of a movement processing where a display position of the image displayed in the display unit 20 by the display processing part 104 moves according to a display time of the image. The orbit processing is performed for preventing a burn-in of the display unit 20. The movement processing part 106 moves the image with a predetermined period (or a selected period) in the orbit processing. The movement processing part 106 moves the display position of the image according to the display time of the image within a movement range having a reference display position of the image in the display unit 20 as a center. As illustrated later, the movement processing part 106 moves the display position of the image within the movement range such that an accumulated display time of the image decreases from a center to a periphery of the movement range.

The time measuring part 108 includes a timer measuring a time and outputs a time signal according to a time progress. The movement processing part 106 may determine whether the period for moving the image by the orbit processing has passed or not based on the time signal outputted from the time measuring part 108. In addition, the movement processing part 106 may calculate the accumulated display time of the display unit 20 based on the time signal outputted from the time measuring part 108.

The display unit 20 is communicatively connected to the display control device 10. The display unit 20 has a display area including the plurality of pixels disposed along an X direction and a Y direction transverse to each other. For example, the display area may have a rectangular shape having sides along the X direction and the Y direction. For example, the display unit 20 may include an organic light emitting diode (OLED) display device, a plasma display panel (PDP) device, a micro light emitting diode (LED) display device, a cathode ray tube (CRT) display device, a liquid crystal display (LCD) device, etc.

For example, the pixel of the display unit 20 may display a color, a black-and-white, a grayscale, etc. The pixel may include a sub-pixel of red, green, blue, etc.

The display device 1 according to a first embodiment of the present disclosure has the above structure.

Figure 2:
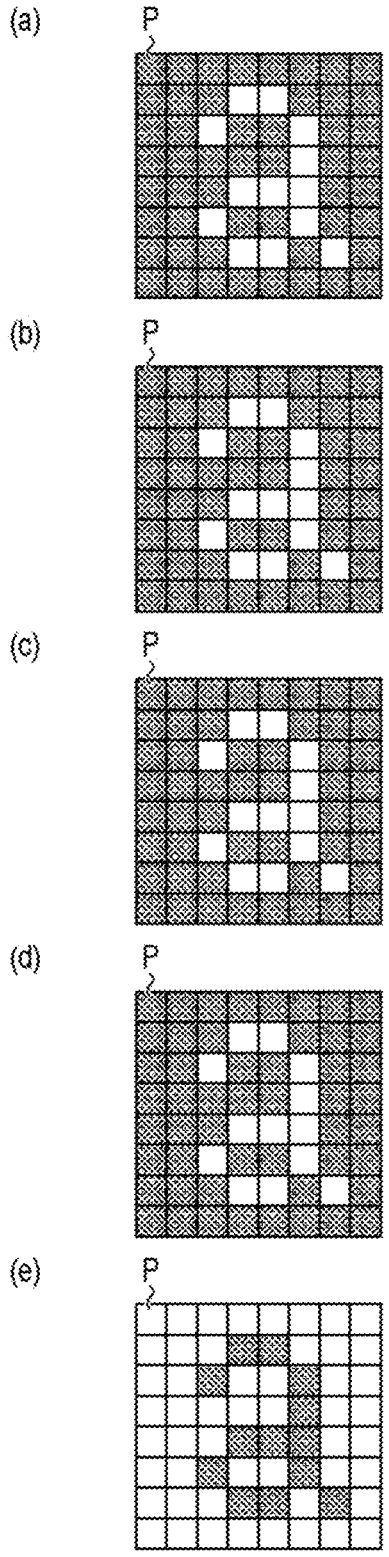

In various display devices, there exists a phenomenon, which is referred to as a burn-in, that a function displaying an image is deteriorated when an equal image is displayed for a long time period (e.g., a time period exceeding a selected threshold period). When the burn-in occurs, a pixel is deteriorated. The pixel deterioration due to the burn-in will be illustrated with reference to FIG. 2. FIG. 2 is a view showing a pixel deterioration due to a burn-in.

In FIGS. 2(*a*) to 2(*e*), a plurality of pixels P are disposed in a matrix along an X direction (e.g., a horizontal direction) and a Y direction (e.g., a vertical direction). In FIGS. 2, 3, 4 and 9, the pixel having a higher luminance corresponds to a brighter color.

In FIGS. 2(*a*) to 2(*d*), an image of a character 'a' is sequentially displayed by a display time of about 100 hours without a movement of a display position in a pixel region including the plurality of pixels P. The character 'a' is displayed by the pixel P having a higher luminance.

A shift position described as an amount of the image movement is further explained as follows. The shift position of the image at the reference display position before movement may be defined as (0, 0), and the shift position of the image which have moved by x along the X direction and y along the Y direction from the reference display position may be defined as (x, y). The reference display position of the image is a position where the image is originally displayed. For example, the reference display position is an initial display position where the image is initially displayed. In FIGS. 2(*a*) to 2(*d*), since the image does not move, the shift position of the image is (0, 0).

In FIG. 2(*e*), after the image display of FIGS. 2(*a*) to 2(*d*) is performed for about 400 hours, a white color is displayed in the entire pixel region including the plurality of pixels P. The luminance with respect to the same operation voltage of the pixel P which has displayed the character 'a' with the higher luminance is reduced as compared with the other pixel P due to deterioration by a stress based on the higher luminance, and the white display becomes insufficient.

As the pixel P displays the image with a higher luminance, the pixel P is more rapidly deteriorated due to a higher stress. The luminance of the deteriorated pixel P with respect to the operation voltage is reduced as compared with the other pixel P. As a result, the pixel deterioration occurs due to the burn-in.

Figure 3:
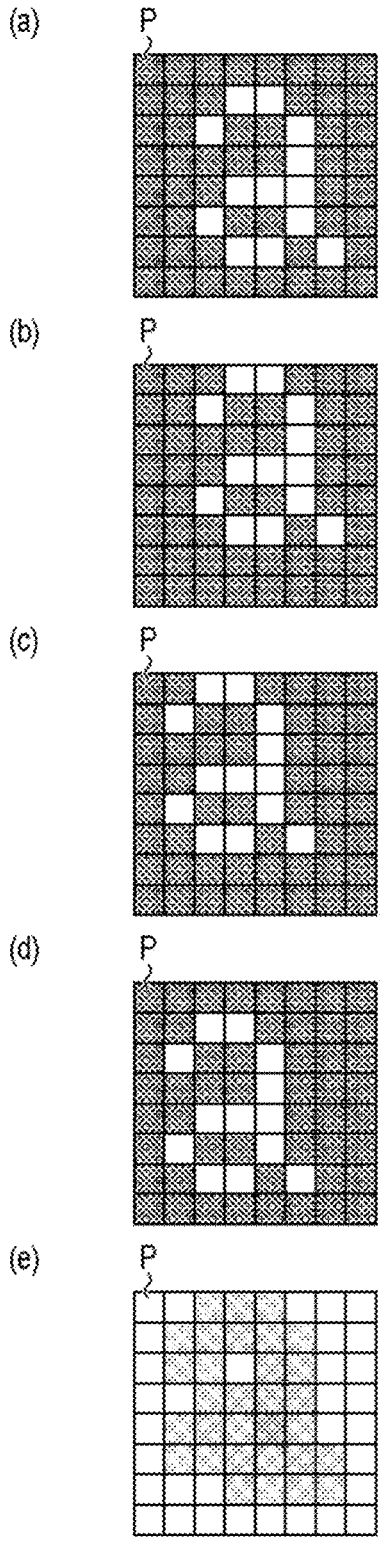
FIG. 3 is a view showing an orbit processing according to the related art where a pixel deterioration due to a burn-in is dispersed.

The orbit processing where the display position of the image is changed according to the display time may be performed as a processing dispersing the pixel deterioration due to the burn-in. The orbit processing dispersing the pixel deterioration due to the burn-in will be illustrated with reference to FIG. 3. FIG. 3 is a view showing an orbit processing according to the related art where a pixel deterioration due to a burn-in is dispersed.

In FIGS. 3(*a*) to 3(*d*), an image of a character 'a' is sequentially displayed by a display time of about 100 hours with a movement of a display position in a pixel region including the plurality of pixels P differently from FIG. 2. Shift positions of the images in FIGS. 3(*a*) to 3(*d*) are (0, 0), (0, 1), (−1, 1) and (−1, 0), respectively. In the orbit processing of FIG. 3, the image exemplarily has a predetermined movement trace.

In FIG. 3(*e*), after the image display of FIGS. 3(*a*) to 3(*d*) is performed for about 400 hours, a white color is displayed in the entire pixel region including the plurality of pixels P. Since the display position of the character 'a' is changed according to the display time, the pixel deterioration due to deterioration by a stress based on the higher luminance is dispersed.

Figure 4:
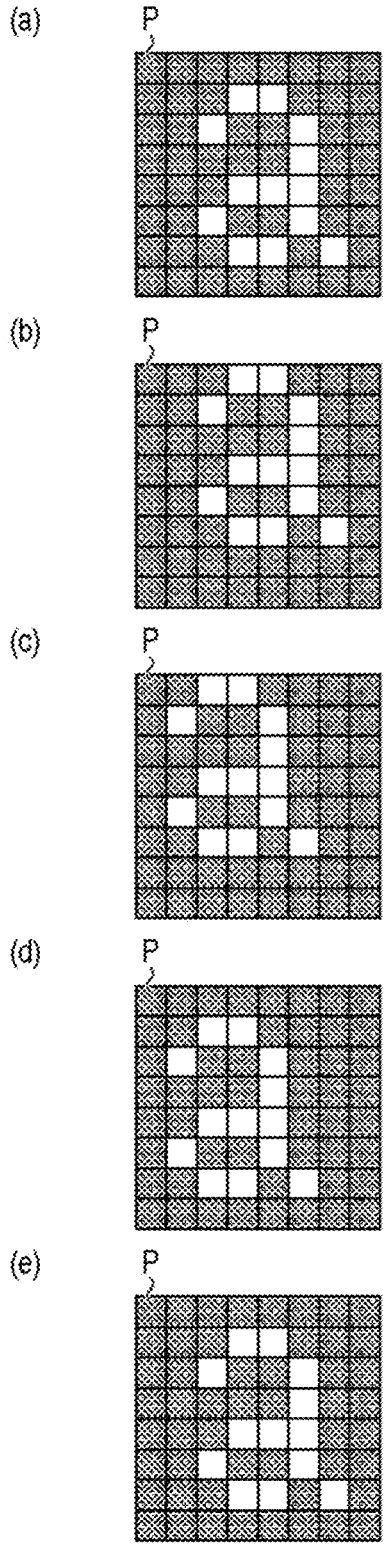
FIG. 4 is a view showing a shift position of an image.

Here, the shift position of the image and the accumulated display time of the image at the shift position are illustrated with reference to FIGS. 4 and 5. The accumulated display time is a time where the display time of the image at the shift position is accumulated. FIG. 4 is a view showing a shift position of an image, and FIG. 5 is a view showing an accumulated display time of an image.

In FIGS. 4(*a*) to 4(*e*), an image of a character 'a' is sequentially displayed by a display time of 100 hours with a movement of a display position. Shift positions of the images in FIGS. 4(*a*) to 4(*e*) are (0, 0), (0, 1), (−1, 1), (−1, 0) and (0, 0), respectively.

Figure 5:
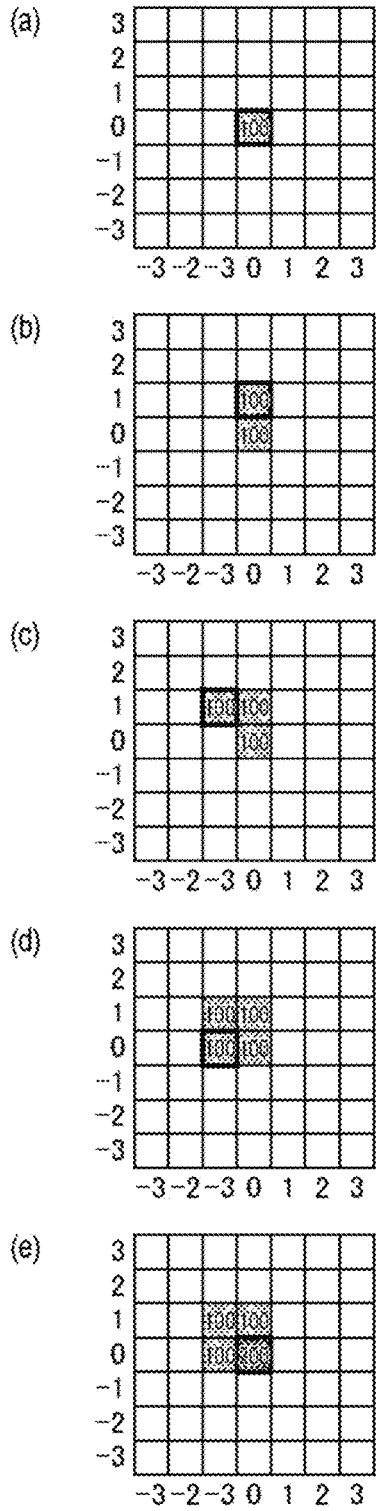
FIG. 5 is a view showing an accumulated display time of an image.

In FIGS. 5(*a*) to 5(*e*), accumulated display times at the shift positions corresponding to FIGS. 4(*a*) to 4(*e*) are displayed in a chessboard pattern where a position x of an X axis and a position y of a Y axis of each shift position (x, y) are obtained along a horizontal direction and a vertical direction, respectively. A number in the chessboard pattern is the accumulated display time expressed as a unit time.

In FIG. 5(*a*), corresponding to FIG. 4(*a*), the accumulated display time at the shift position of (0, 0) is about 100 hours. In FIG. 5(*b*), corresponding to FIG. 4(*b*), the accumulated display time at the shift position of (0, 1) is about 100 hours. In FIG. 5(*c*), corresponding to FIG. 4(*c*), the accumulated display time at the shift position of (−1, 1) is about 100 hours. In FIG. 5(*d*), corresponding to FIG. 4(*d*), the accumulated display time at the shift position of (−1, 0) is about 100 hours. In FIG. 5(*e*), corresponding to FIG. 4(*e*), the accumulated display time at the shift position of (0, 0) is about 200 hours as a result of adding about 100 hours of FIG. 5(*a*) and about 100 hours.

As the accumulated display time of the pixel increases, the pixel may be deteriorated due to the stress. In the orbit processing, since the display position moves, the pixel deterioration may be dispersed. As a result, it becomes difficult for a user to recognize the pixel deterioration.

However, in an image such as a star sky, a bright light of a night view, etc., where some pixels such as one pixel or several pixels locally have a relatively high luminance, a steep boundary portion may be generated in a stress amount by the orbit processing of the related art. As a result, the pixel deterioration of the image where some pixels locally have a relatively high luminance through the orbit processing of the related art may be easily recognized by a user.

In the display control device 10 according to a first embodiment of the present disclosure, the movement processing part 106 performs an orbit processing where the display position is changed such that the accumulated display time is reduced from the center of the reference display position of the image in the display unit 20 to the periphery of the movement range. As a result, in the display control device 10, the stress applied to the pixel of the image where some pixels locally have a relatively high luminance may be excellently dispersed through the orbit processing. Since the boundary portion in the stress amount applied to the pixel is removed, the display control device 10 may perform an image display where the pixel deterioration is not recognized by a user.

Figure 6:
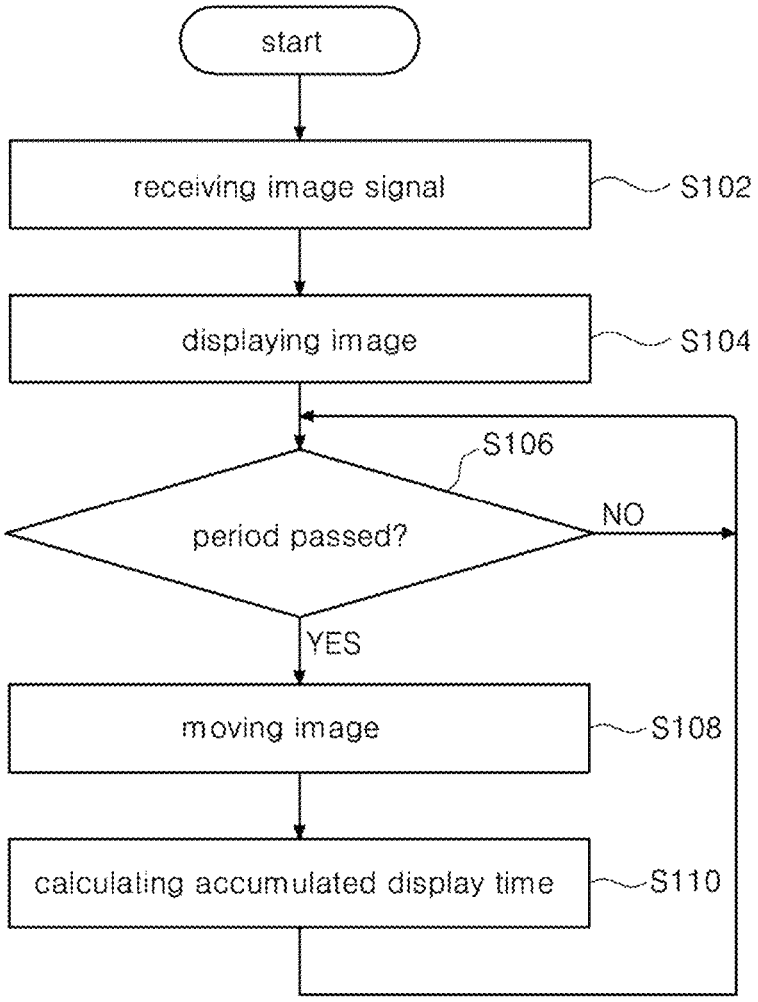
FIG. 6 is a flow chart showing an operation of a display control device according to a first embodiment of the present disclosure.
Figure 7:
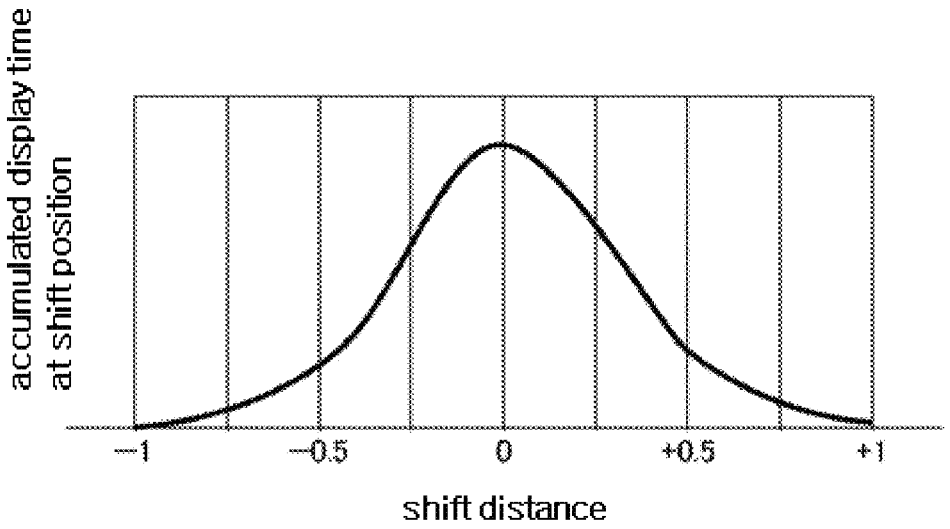
FIG. 7 is a graph showing an accumulated display time of an orbit processing in a display control device according to a first embodiment of the present disclosure.
Figure 8:
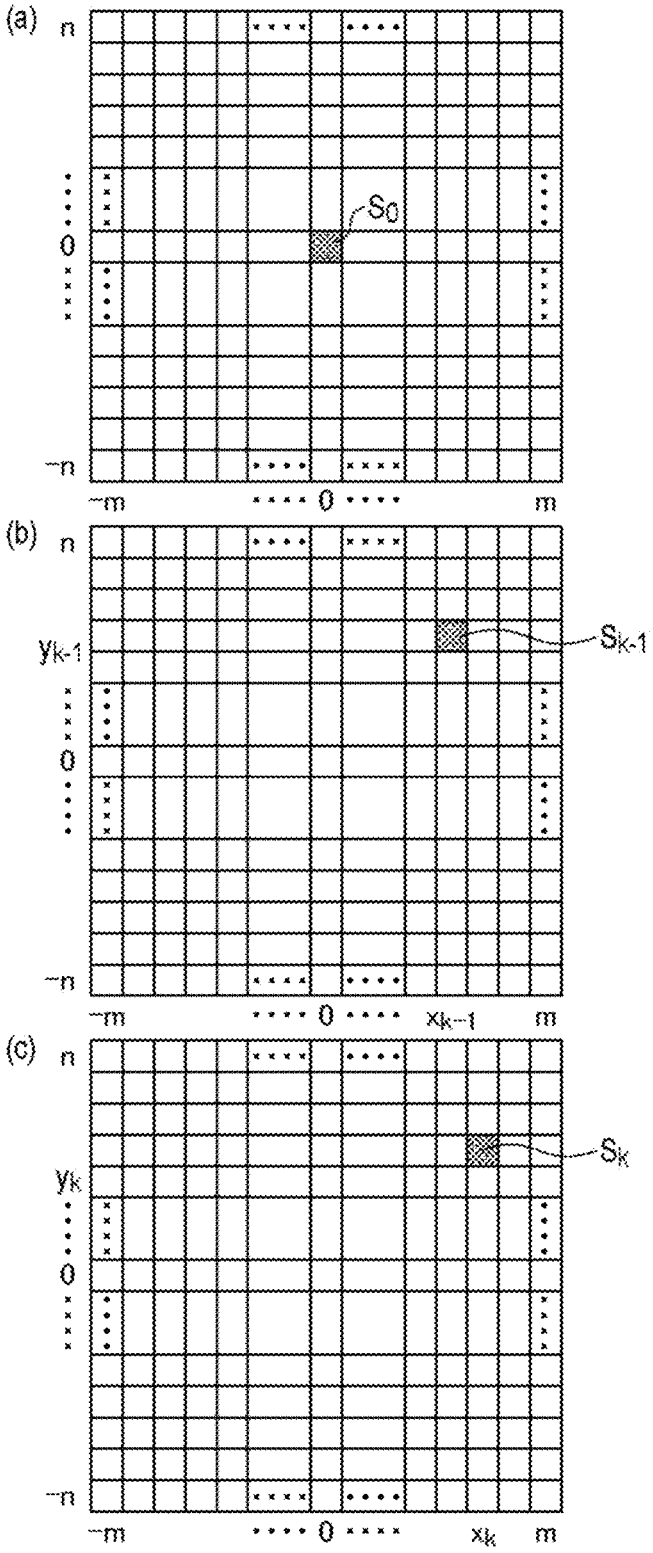
FIG. 8 is a view showing an image movement according to an orbit processing by a display control device according to a first embodiment of the present disclosure.
Figure 9:
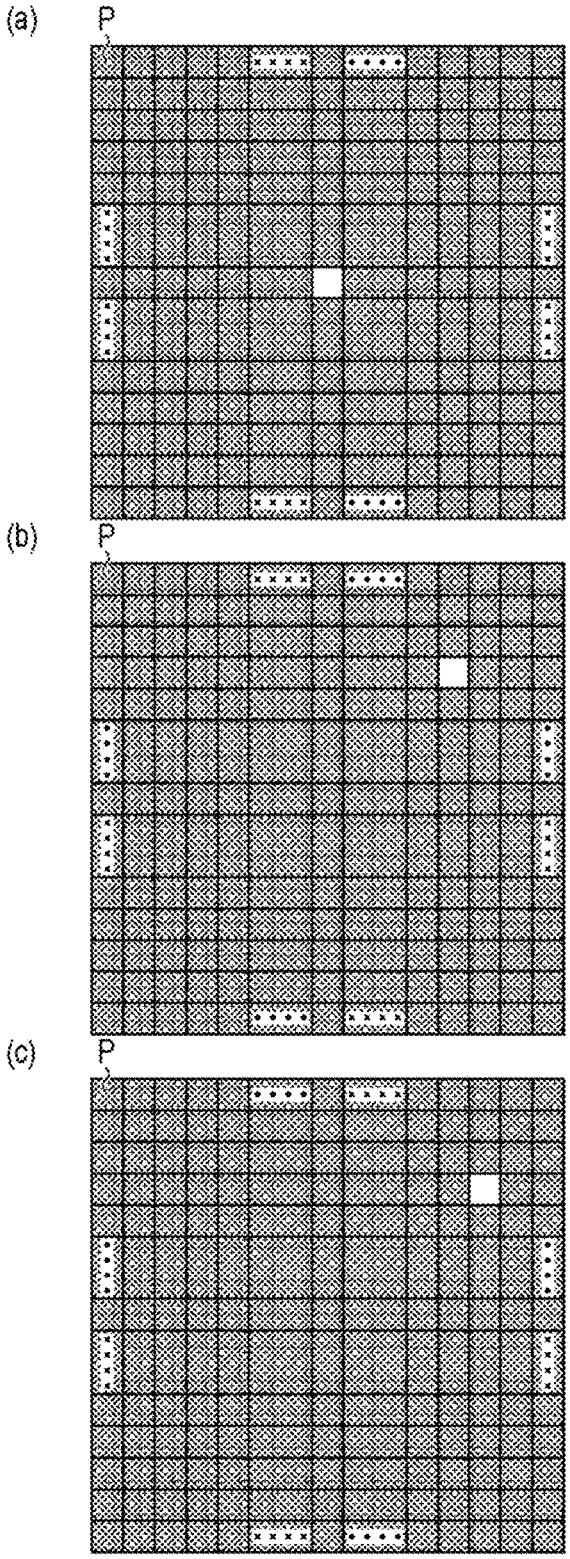
FIG. 9 is a view showing a shift position and an accumulated display time of an image moved by a display control device according to a first embodiment of the present disclosure.

The operation of the display control device 10 is illustrated with reference to FIGS. 6 to 9. FIG. 6 is a flow chart showing an operation of a display control device according to a first embodiment of the present disclosure, FIG. 7 is a graph showing an accumulated display time of an orbit processing in a display control device according to a first embodiment of the present disclosure, FIG. 8 is a view showing an image movement according to an orbit processing by a display control device according to a first embodiment of the present disclosure, and FIG. 9 is a view showing a shift position and an accumulated display time of an image moved by a display control device according to a first embodiment of the present disclosure. A method of controlling a display device is performed according to an operation of the display control device 10 according to a first embodiment of the present disclosure.

The display processing part 104 receives the image signal supplied from the inputting part 102 (step S102).

Next, the display processing part 104 controls the display unit 20 according to the image signal and displays the image in the display unit 20 (step S104). The display processing part 104 may display the image where some pixels such as one pixel or several pixels are turned on according to the image signal. Alternatively, the display processing part 104 may display an image where the plurality of pixels are turned on or various images. The display processing part 104 displays the image at the reference position.

Next, the movement processing part 106 determines whether the period for moving the image has passed or not based on the time signal outputted from the time measuring part 108 (step S106). For example, the period for moving the image may be determined equal to or longer than about 1 hour. However, other periods may be set other than an hour.

When the movement processing part 106 determines that the period has passed (step S106, YES), the orbit processing where the image moves in the display unit 20 is performed (step S108). In the orbit processing, the movement processing part 106 changes the display position of the image such that the image is disposed at the predetermined shift position.

Next, the movement processing part 106 calculates the accumulated display time at the shift position where the image is disposed (step S110).

Next, the movement processing part 106 performs the step S106 again and determines whether the period for moving the image has passed or not (step S106).

The movement processing part 106 repeatedly performs the steps S106 to S110 for the image displayed in the display unit 20. As a result, the movement processing part 106 repeatedly performs the orbit processing where the image moves whenever the period for moving the image has passed.

When the display position of the image is changed in the step S106, the display position of the image is changed within the movement range having the reference display position of the image as a center. The movement processing part 106 changes the display position of the image at the timing where the total display time of the image in the display unit 20 becomes over a predetermined time such that the accumulated display time is reduced from the center to the periphery of the movement range. For example, the accumulated display time may be smoothly reduced.

The total display time of the image in the display unit 20 is a sum of the display times of the image have passed from the initial display of the image. The total display time having distribution of the accumulated display time may vary according to the period for moving the image. For example, the total display time may be equal to or longer than about 10000 hours.

For example, the movement processing part 106 may change the display position of the image by pixel within the movement range satisfying that $-m \le x \le m$ and $-n \le y \le n$ (shift position is (x, y), each of m and n is a positive integer). Within the above movement range, there exist shift positions of $(2m+1)*(2n+1)$. A shift distance D with respect to the shift position (x, y) is defined as a following equation (1).

Equation 1

$$D = \left(\left(\frac{x}{m}\right)^2 + \left(\frac{y}{n}\right)^2\right)^{\frac{1}{2}} \quad (1)$$

The movement processing part 106 moves the display position of the image to obtain the accumulated display time distribution where the accumulated display time at the shift position is gradually reduced according to increase of the shift distance at the timing where the total display time of the image in the display unit 20 is over a predetermined time. For example, the movement processing part 106 may move the display position of the image to obtain the accumulated display time distribution where the accumulated display time is smoothly and gradually reduced.

FIG. 7 shows an example distribution of the accumulated display time for the shift distance obtained by the display control device 10 according to a first embodiment of the present disclosure. In FIG. 7, a horizontal axis corresponds to the shift distance for the shift position and a vertical axis corresponds to the accumulated display time at the shift position. Regions having the shift distances of positive and negative values correspond to symmetric shift positions with respect to the shift position of (0, 0).

As a result of the orbit processing by the movement processing part 106, the accumulated display time is distributed to be gradually reduced as the absolute value of the shift distance increases. The accumulated display time may be smoothly and gradually reduced.

The movement processing part 106 may change the display position of the image to obtain the distribution of the accumulated display time of FIG. 7. For example, the movement processing part 106 may change the display position of the image such that a maximum value of the accumulated display time at the shift position where the shift distance D is equal to or greater than 0.75 is smaller than a minimum value of the accumulated display time at the shift position where the shift distance D is equal to or smaller than 0.25.

For example, the movement processing part 106 may change the display position of the image such that the accumulated display time of the image is reduced from the center to the periphery of the movement range by determining the shift position according to the probability. The movement processing part 106 may calculate and probabilistically determine the shift position where the image moves according to a relation equation using a random number. The movement processing part 106 may calculate and determine the shift position according to the following relation equations.

The movement processing part 106 may calculate and determine the shift position ($x_k$, $y_k$) where the kth image (k is a positive integer) moves according to equations (2-1) and (2-2). The sign function sgn(x) returns −1 when the real number x is a negative number, returns 0 when the real number x is 0, and returns 1 when the real number x is a positive number. The round function round(x) returns a value of an integer which is obtained by rounding off the real number x. The random number $R_k$ satisfies $0 \le R_k \le 1$, and the random number $R_k'$ satisfies $0 \le R_k' \le 1$. For example, the random numbers $R_k$ and $R_k'$ may be generated as a pseudo random number.

Equation 2-1

$$x_k = x_{k-1} + \mathrm{sgn}\left(\mathrm{round}\left(10 \cdot (2 \cdot R_k - 1)^{\frac{1}{3}}\right) - x_{k-1}\right) \quad (2\text{-}1)$$

Equation 2-2

$$y_k = y_{k-1} + \mathrm{sgn}\left(\mathrm{round}\left(10 \cdot (2 \cdot R_k' - 1)^{\frac{1}{3}}\right) - y_{k-1}\right) \quad (2\text{-}2)$$

When the equations (2-1) and (2-2) are used, the movement processing part 106 calculates and determines the shift position ($x_k$, $y_k$) where the kth image moves based on the shift position ($x_{k-1}$, $y_{k-1}$) where the (k−1)th image moves. The movement processing part 106 moves the image based on the display position before the movement of the image.

FIGS. 8(*a*), 8(*b*) and 8(*c*) show the shift positions of $S_0(x_0, y_0)$, $S_{k-1}(x_{k-1}, y_{k-1})$ and $S_k(x_k, y_k)$ where the image moves by the movement processing part 106. The movement processing part 106 may calculate and determine the shift position ($x_k$, $y_k$) based on the shift position ($x_{k-1}$, $y_{k-1}$).

FIGS. 9(*a*), 9(*b*) and 9(*c*) show the display positions of the image due to one pixel turned on and corresponding to the shift positions $S_0(x_0, y_0)$, $S_{k-1}(x_{k-1}, y_{k-1})$ and $S_k(x_k, y_k)$ of FIGS. 8(*a*), 8(*b*) and 8(*c*). The movement processing part 106 may move the image due to the turn-on of the pixel P according to the shift position $S_k(x_k, y_k)$.

In a display control device according to a second embodiment of the present disclosure, the movement processing part 106 may calculate and determine the shift position using various equations other than the equations (2-1) and (2-2). For example, the movement processing part 106 may calculate and determine the shift position ($x_k$, $y_k$) using equations (3-1) and (3-2).

Equation 3-1

$$x_k = \mathrm{round}(r_k \cdot \cos\theta_k) \quad (3\text{-}1)$$

Equation 3-2

$$y_k = \mathrm{round}(r_k \cdot \sin\theta_k) \quad (3\text{-}2)$$

Here, $\gamma_k$ and $\theta_k$ are defined by equations (3-3) and (3-4).

Equation 3-3

$$r_k = 10.5 \cdot R_k^{1/2} \quad (3\text{-}3)$$

Equation 3-4

$$\theta_k = 2\pi \cdot R_k' \quad (3\text{-}4)$$

When the equations (3-1) and (3-2) are used, the movement processing part 106 calculates and determines the shift position ($x_k$, $y_k$) where the kth image moves independently on the shift position ($x_{k-1}$, $y_{k-1}$) where the (k−1)th image moves. The movement processing part 106 moves the image independently on the display position before the movement of the image.

The distribution of the accumulated display time where the accumulated time is reduced from the center to the periphery of the movement range by using the equations including a random number and the equations including a sign function such as the equations (2-1) and (2-2) and the equations (3-1) and (3-2) is easily obtained. The coefficient, the integer and the index of the above equations are not limited thereto and may properly vary.

In the display control device according to the first and second embodiments of the present disclosure, the display position of the image is changed such that the accumulated display time of the image is reduced from the center to the periphery of the movement range. As a result, the stress applied to the pixel is favorably dispersed even in the image where some pixels locally have a relatively high luminance. The image display where the pixel deterioration is not recognized by a user even in the image where some pixels locally have a relatively high luminance is performed.

Embodiment

Test result of the display control device according to embodiments of the present disclosure is illustrated with reference to FIGS. 10 to 15. In the test, when the image moves according to the orbit processing of the first and second embodiments and first to fourth comparison examples, the accumulated display time corresponding to the stress amount applied to the pixel is calculated by a simulation.

Figure 10:
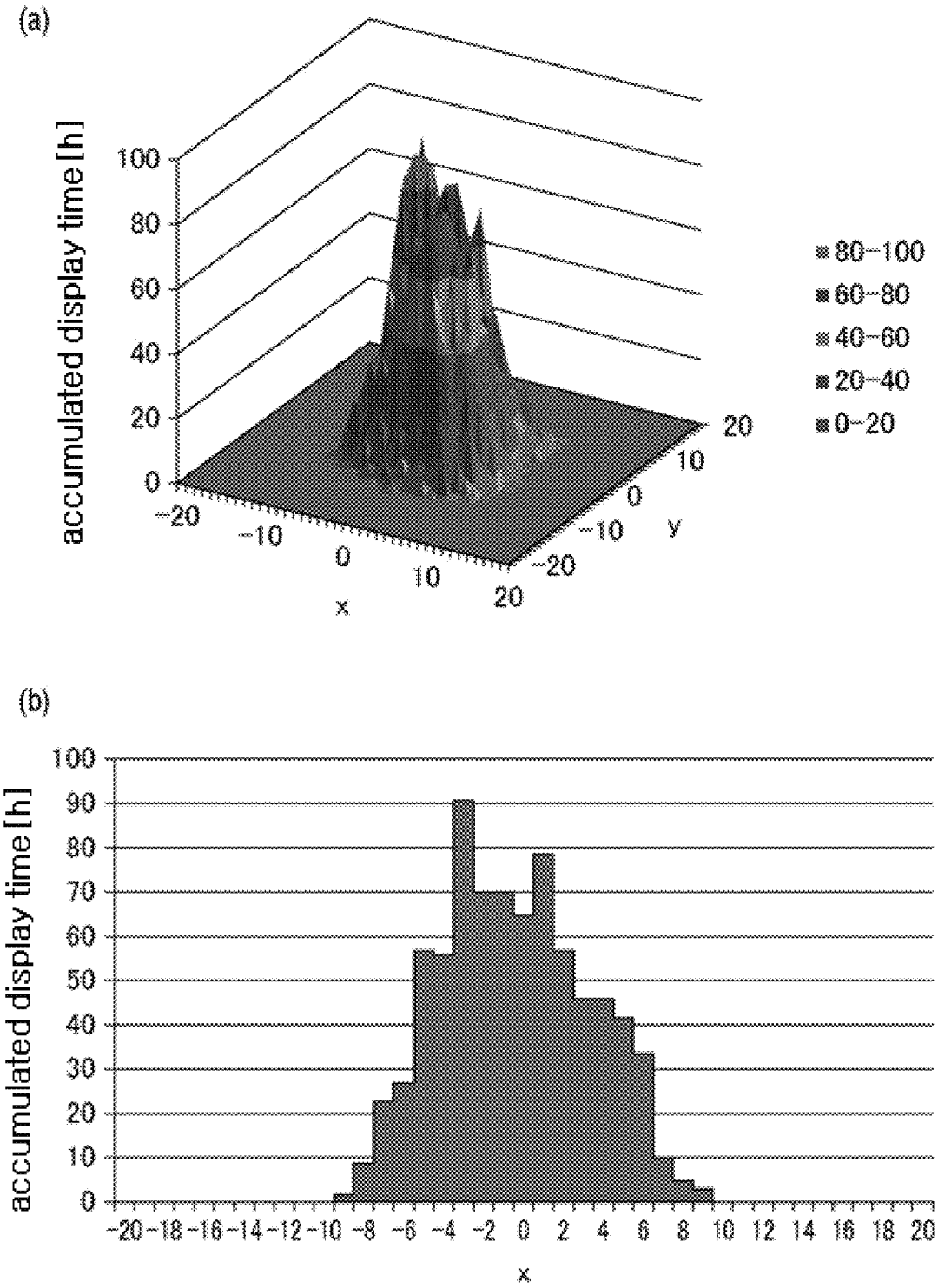
FIG. 10 is a graph showing a simulation result of an accumulated display time of a display control device according to a first embodiment of the present disclosure.

In the first embodiment, the accumulated display time where the image of one pixel turned on moves to the shift position obtained by the orbit processing using the equations (2-1) and (2-2) is calculated by a simulation. In the simulation, the period where the image moves is determined as 1 hour, and the total display time of the image is determined as 10000 hours. The simulation result of the first embodiment is shown in FIG. 10. FIG. 10(*a*) shows the simulation result of the first embodiment where the accumulated display time at the shift position (x, y) is calculated. FIG. 10(*b*) shows the accumulated display time at the shift position (x, 0) among the simulation result of FIG. 10(*a*). In FIGS. 10(*a*) and 10(*b*), a unit of the accumulated display time is an hour (h).

Figure 11:
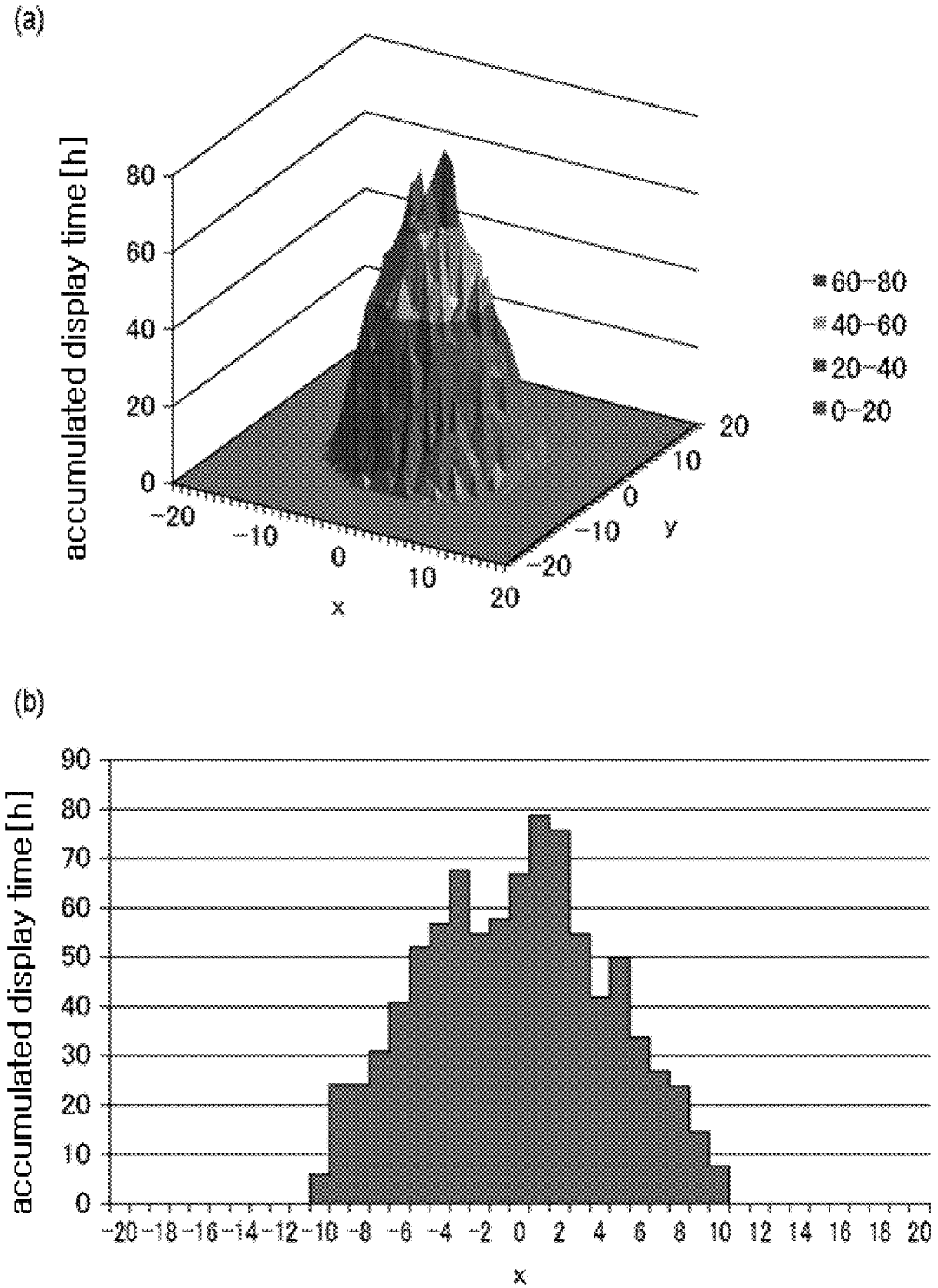
FIG. 11 is a graph showing a simulation result of an accumulated display time of a display control device according to a second embodiment of the present disclosure.

In the second embodiment, the accumulated display time where the image of one pixel turned on moves to the shift position obtained by the orbit processing using the equations (3-1) and (3-2) is calculated by a simulation. The simulation condition of the second embodiment is the same as that of the first embodiment. The simulation result of the second embodiment is shown in FIG. 11. FIG. 11(*a*) shows the simulation result of the second embodiment where the accumulated display time at the shift position (x, y) is calculated. FIG. 11(*b*) shows the accumulated display time at the shift position (x, 0) among the simulation result of FIG. 11(*a*). In FIGS. 11(*a*) and 11(*b*), a unit of the accumulated display time is an hour (h).

Figure 12:
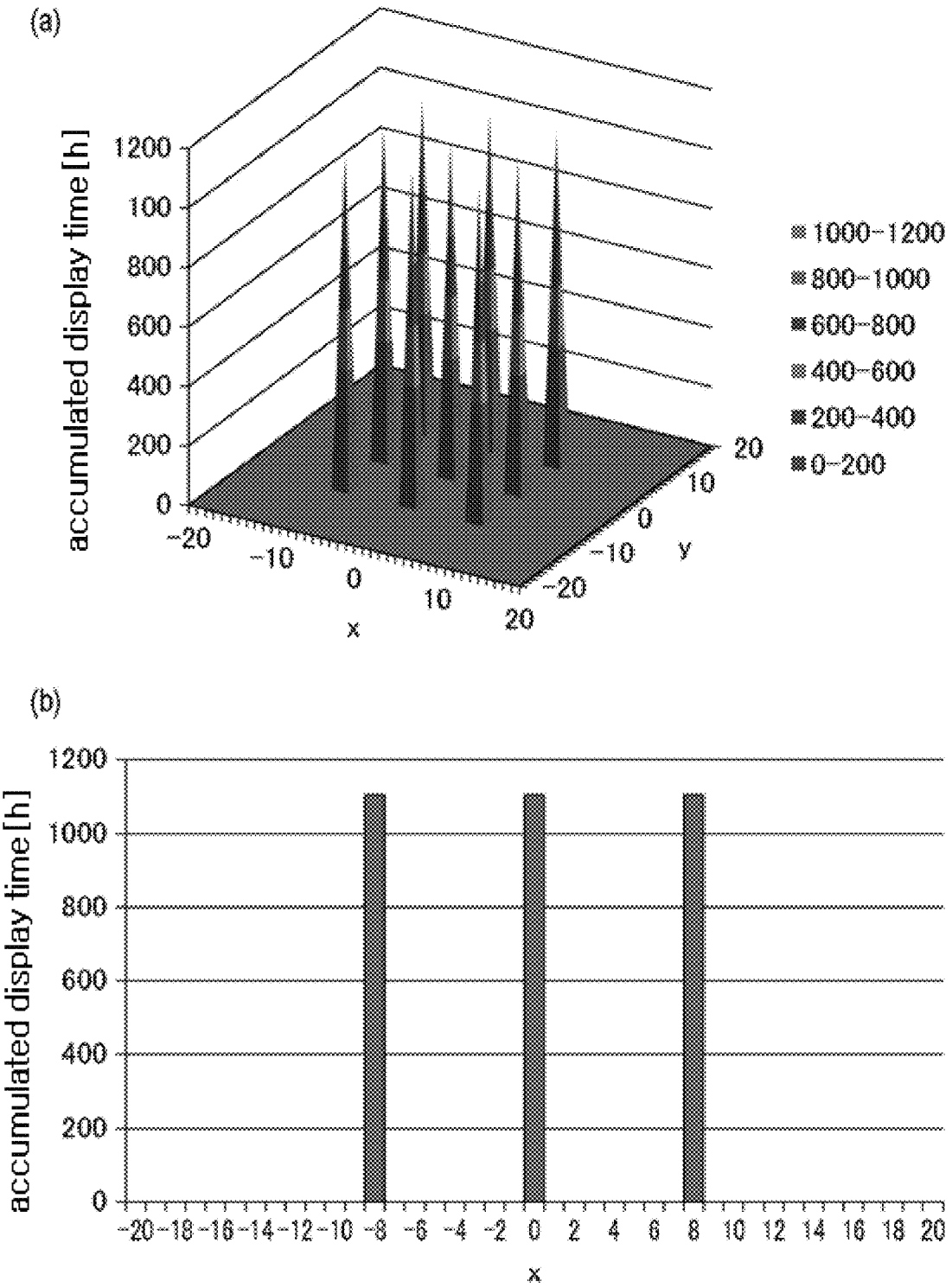
FIG. 12 is a graph showing a simulation result of an accumulated display time of a display control device according to a first comparison example.

In the first comparison example, the accumulated display time where the image of one pixel turned on moves to the shift position obtained by the orbit processing of the patent document 1 is calculated by a simulation. The simulation condition of the first comparison example is the same as that of the first embodiment. The simulation result of the first comparison example is shown in FIG. 12. FIG. 12(*a*) shows the simulation result of the first comparison example where the accumulated display time at the shift position (x, y) is calculated. FIG. 12(*b*) shows the accumulated display time at the shift position (x, 0) among the simulation result of FIG. 12(*a*). In FIGS. 12(*a*) and 12(*b*), a unit of the accumulated display time is an hour (h).

Figure 13:
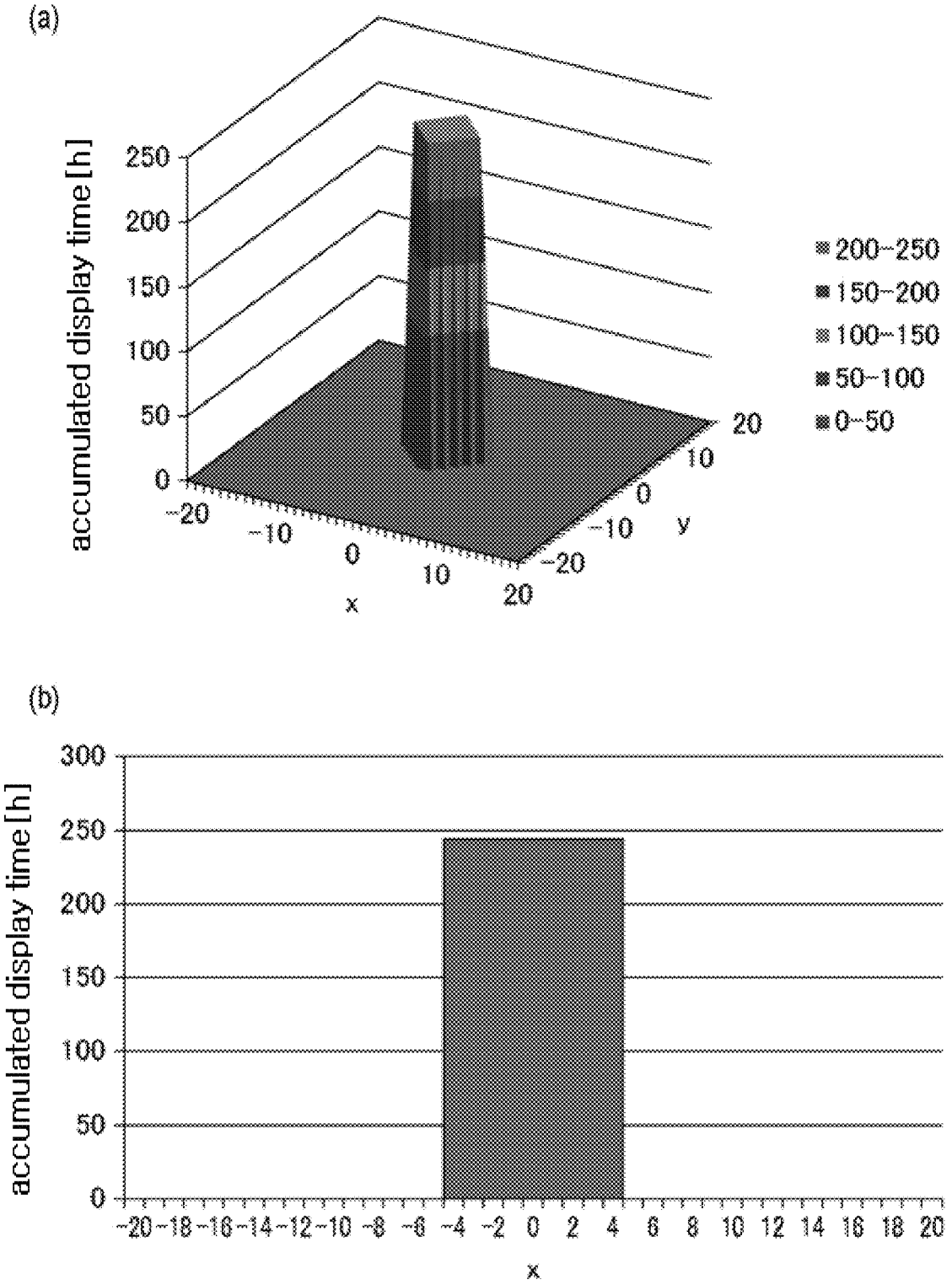
FIG. 13 is a graph showing a simulation result of an accumulated display time of a display control device according to a second comparison example.

In the second comparison example, the accumulated display time where the image of one pixel turned on moves to the shift position obtained by the orbit processing of the patent document 2 is calculated by a simulation. The simulation condition of the second comparison example is the same as that of the first embodiment. The simulation result of the second comparison example is shown in FIG. 13. FIG. 13(*a*) shows the simulation result of the second comparison example where the accumulated display time at the shift position (x, y) is calculated. FIG. 13(*b*) shows the accumulated display time at the shift position (x, 0) among the simulation result of FIG. 13(*a*). In FIGS. 13(*a*) and 13(*b*), a unit of the accumulated display time is an hour (h).

Figure 14:
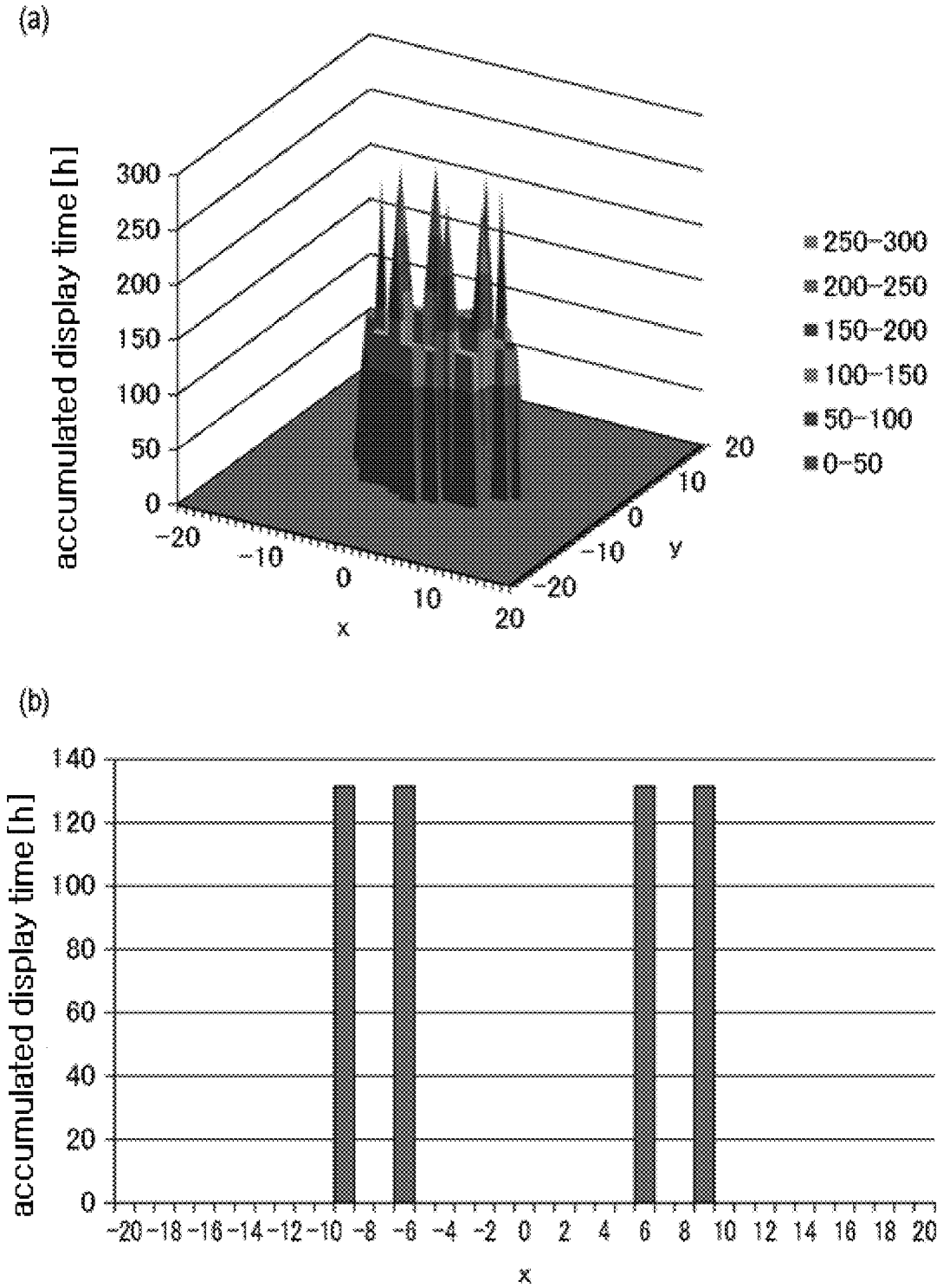
FIG. 14 is a graph showing a simulation result of an accumulated display time of a display control device according to a third comparison example.

In the third comparison example, the accumulated display time where the image of one pixel turned on moves to the shift position obtained by the orbit processing of the patent document 3 is calculated by a simulation. The simulation condition of the third comparison example is the same as that of the first embodiment. The simulation result of the third comparison example is shown in FIG. 14. FIG. 14(*a*) shows the simulation result of the third comparison example where the accumulated display time at the shift position (x, y) is calculated. FIG. 14(*b*) shows the accumulated display time at the shift position (x, 0) among the simulation result of FIG. 14(*a*). In FIGS. 14(*a*) and 14(*b*), a unit of the accumulated display time is an hour (h).

Figure 15:
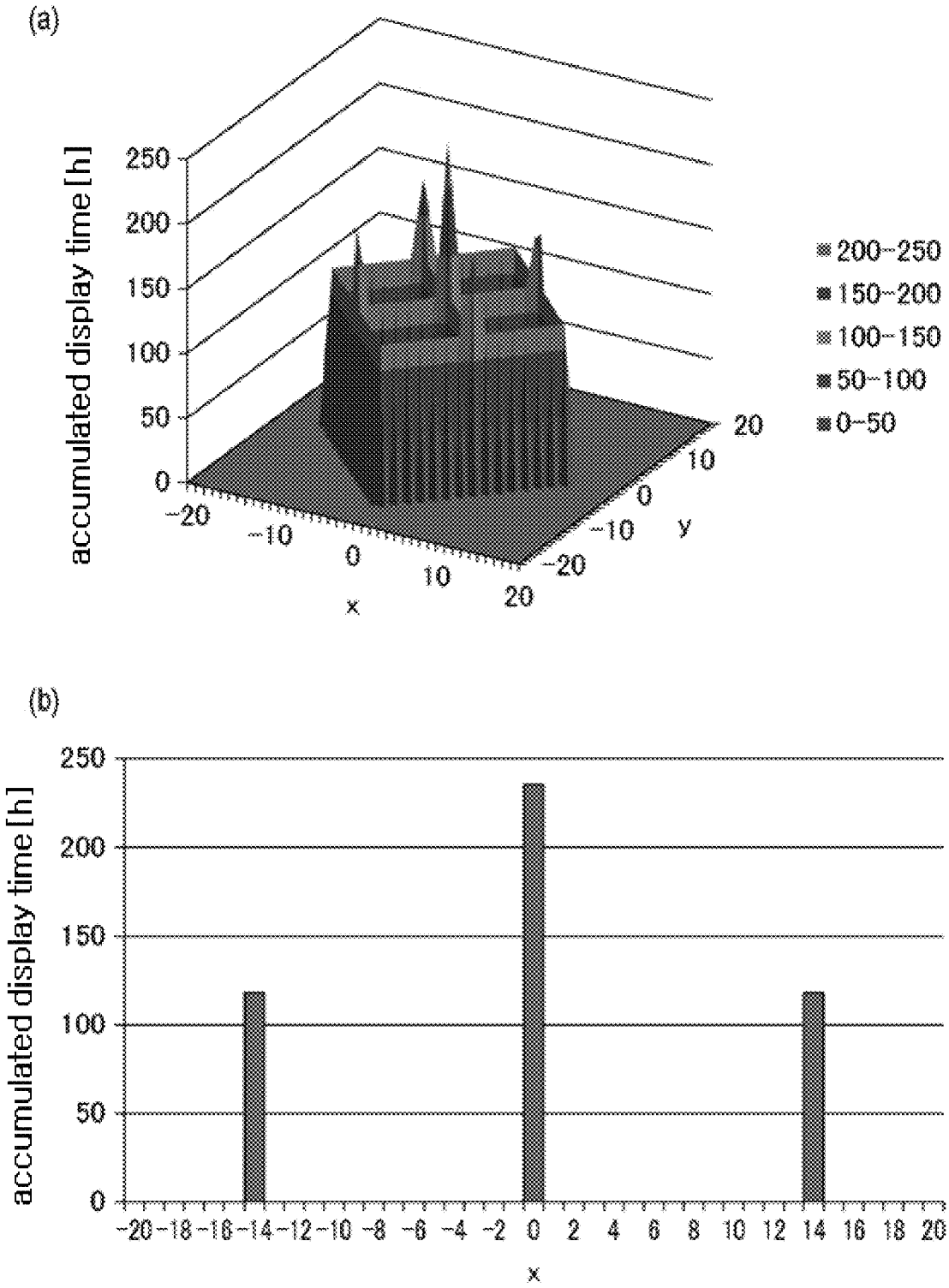
FIG. 15 is a graph showing a simulation result of an accumulated display time of a display control device according to a fourth comparison example.

In the fourth comparison example, the accumulated display time where the image of one pixel turned on moves to the shift position obtained by the orbit processing of the patent document 4 is calculated by a simulation. The simulation condition of the fourth comparison example is the same as that of the first embodiment. The simulation result of the fourth comparison example is shown in FIG. 15. FIG. 15(*a*) shows the simulation result of the fourth comparison example where the accumulated display time at the shift position (x, y) is calculated. FIG. 15(*b*) shows the accumulated display time at the shift position (x, 0) among the simulation result of FIG. 15(*a*). In FIGS. 15(*a*) and 15(*b*), a unit of the accumulated display time is an hour (h).

As shown in FIGS. 12 to 15, a steep boundary portion of the accumulated display time is generated in the movement range of the image of the comparison examples 1 to 4.

As shown in FIGS. 10 and 11, a steep boundary portion of the accumulated display time is not generated in the movement range of the image of the first and second embodiments. As a result, since the stress applied to the pixel of the first and second embodiments is more favorably dispersed as compared with the comparison examples 1 to 4, it is verified that a user hardly recognizes the pixel deterioration.

In the display control device according to the present disclosure, the stress applied to the pixel is favorably dispersed even in the image where some pixels locally have a relatively high luminance.

It will be apparent to those skilled in the art that various modifications and variation can be made in the present disclosure without departing from the spirit or scope of the disclosure. Thus, it is intended that the present disclosure cover the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display control device, comprising:

a display processing circuitry displaying an image in a display unit; and a movement processing circuitry changing a display position of the image according to a display time of the image within a movement range having a reference display position of the image in the display unit as a center, wherein the movement processing circuitry changes the display position within the movement range such that an accumulated display time of the image is reduced from the center to a periphery of the movement range, and wherein the movement processing circuitry probabilistically determines a shift position where the image moves.

2. The device of claim 1, wherein the movement processing circuitry moves the image based on the display position before movement of the image.

3. The device of claim 1, wherein the movement processing circuitry moves the image independently on the display position before movement of the image.

4. The device of claim 1, where the display unit includes a pixel disposed along an X direction and a Y direction, the X direction being transverse to the Y direction, wherein the movement processing circuitry changes the display position within the movement range such that the image moves to a shift position (x, y) by x pixels along the X direction and y pixels along the Y direction from the reference display position and the shift position (x, y) satisfies $-m \le x \le m$ and $-n \le y \le n$, wherein each of m and n is a positive integer, and wherein the movement processing circuitry changes the display position such that a maximum value of the accumulated display time at the shift position where a shift distance D defined by an Equation 1 is equal to or greater than 0.75 is smaller than a minimum value of the accumulated display time at the shift position where the shift distance D is equal to or smaller than 0.25

Equation 1

$$D = \left(\left(\frac{x}{m}\right)^2 + \left(\frac{y}{n}\right)^2\right)^{\frac{1}{2}}. \quad (1)$$

5. The device of claim 1, wherein the movement processing circuitry determines the shift position where the image moves according to a relation equation including a random number.

6. The device of claim 5, wherein the relation equation includes a sign function.

7. The device of claim 5, wherein the relation equation includes a round function.

8. The device of claim 1, wherein the movement processing circuitry changes the display position with a period.

9. The device of claim 8, wherein the movement processing circuitry changes the display position with the period equal to or longer than about 1 hour.

10. The device of claim 1, wherein the movement processing circuitry changes the display position such that the accumulated display time is reduced from the center to the periphery of the movement range at a timing where a total display time of the image in the display unit is equal to or longer than about 10000 hours.

11. The device of claim 1, wherein the display unit includes an organic light emitting display device.

12. A display device, comprising:

a display control device, comprising:

a display processing circuitry displaying an image in a display unit; and a movement processing circuitry changing a display position of the image according to a display time of the image within a movement range having a reference display position of the image in the display unit as a center, wherein the movement processing circuitry changes the display position within the movement range such that an accumulated display time of the image is reduced from the center to a periphery of the movement range, and wherein the movement processing circuitry probabilistically determines a shift position where the image moves; and the display unit operatively coupled to the display control device.

13. A method of controlling a display device, comprising:

displaying an image in a display part; and changing a display position of the image based on a display time of the image within a movement range having a reference display position of the image in the display unit as a center, wherein changing the display position is performed such that an accumulated display time of the image is reduced from the center to a periphery of the movement range, and wherein a shift position where the image moves is probabilistically determined.

* * * * *